US012389988B2

(12) United States Patent
Paik et al.

(10) Patent No.: US 12,389,988 B2
(45) Date of Patent: Aug. 19, 2025

(54) STRAP BAR DEVICE OF STRAP ACCESSORY

(71) Applicant: WOOJIN PLASTIC Co., Ltd., Namyangju-si (KR)

(72) Inventors: Ji Sook Paik, Seoul (KR); Nan Hee Paik, Seoul (KR); Ji Hye Paik, Seoul (KR); Ji Won Son, Seoul (KR)

(73) Assignee: WOOJIN PLASTIC CO., LTD., Namyangju-si (KR)

( * ) Notice: Subject to any disclaimer, the term of this patent is extended or adjusted under 35 U.S.C. 154(b) by 0 days.

(21) Appl. No.: 18/386,883

(22) Filed: Nov. 3, 2023

(65) Prior Publication Data

US 2025/0082070 A1 Mar. 13, 2025

(30) Foreign Application Priority Data

Sep. 7, 2023 (KR) ..... 10-2023-0118734

(51) Int. Cl.
*A44B 11/00* (2006.01)

(52) U.S. Cl.
CPC ..... *A44B 11/006* (2013.01)

(58) Field of Classification Search
CPC . A44B 11/006; A44B 11/2553; A44B 11/065; A44B 11/2523; A44B 11/04; A44B 11/2592; A45F 3/047; A45F 2003/001; A45F 3/00
See application file for complete search history.

(56) References Cited

U.S. PATENT DOCUMENTS

| | | | | |
|---|---|---|---|---|
| 125,744 | A | 4/1872 | Low | |
| 9,474,333 | B2 * | 10/2016 | Iannello | A44B 11/266 |
| 9,986,789 | B2 * | 6/2018 | Blackman | A44B 11/2592 |
| 2003/0145435 | A1 * | 8/2003 | Carver | A44B 11/04 24/115 F |
| 2015/0208768 | A1 | 7/2015 | Iannello et al. | |
| 2023/0119434 | A1 * | 4/2023 | Chan | A44B 11/28 24/166 |

FOREIGN PATENT DOCUMENTS

| | | | |
|---|---|---|---|
| DE | 202010013986 | U1 | 1/2012 |
| JP | H02-125613 | U | 10/1990 |
| JP | 2509010 | Y2 | 8/1996 |
| KR | 10-1030366 | B1 | 4/2011 |
| WO | WO 2009/141942 | A1 | 11/2009 |
| WO | WO 2014/019009 | A2 | 2/2014 |

OTHER PUBLICATIONS

Korean Office Action for related KR Application No. 10-2023-0118734 mailed Nov. 15, 2024 from Korean Intellectual Property Office.
Extended European Search Report for related EP Application No. 23207790.9 mailed Apr. 15, 2024 from European Patent Office.

* cited by examiner

*Primary Examiner* — Jason W San
*Assistant Examiner* — Louis A Mercado
(74) *Attorney, Agent, or Firm* — Paratus Law Group, PLLC

(57) ABSTRACT

A strap bar device includes: a strap accessory which includes two support parts facing each other to be spaced apart from each other, and a through-hole and a support groove formed in the two support parts to face each other; and a strap bar which is inserted through the through-hole and is supported in the through-hole and the support groove. A strap is connected to the strap bar.

8 Claims, 15 Drawing Sheets

(a)

(b)

(a)

(b)

(a)

(b)

STRAP BAR DEVICE OF STRAP ACCESSORY

CROSS-REFERENCE TO PRIOR APPLICATIONS

This application claims priority to Korean Patent Application No. 10-2023-0118734 (filed on Sep. 7, 2023), which is hereby incorporated by reference in its entirety.

BACKGROUND

The present invention relates to a strap bar device of a strap accessory which enables the detachable installation of a strap bar for hooking and connecting a belt or a strap of a strap accessory used by connecting the belt or the strap.

As needed, many accessories are mounted and used on backpacks, bags, hats, or clothing etc., and such accessories are connected using belts, strings, or straps.

For example, as illustrated in FIG. 1, on a mountaineering backpack, a plurality of straps S are installed at various parts, and various types of strap accessories such as strap adjusters 100, rings, or loops are mounted on the straps S for use according to their functions. Additionally, there are straps for fixing and buckles 200 for binding the straps.

Moreover, during activities such as camping or mountaineering, various items, such as lanterns, cups, sticks, water bottles, etc., are stored in the backpack or hung on loops using straps for portability.

Each of the plurality of straps fundamentally mounted on the backpack has one end which is sewed and fixed to the backpack, and the other end which is used by connecting other straps or strap accessories.

For the straps to be connected, strap bars that can wrap and hook the straps are needed in the strap accessories. In general, the strap bars are basically formed in most of the strap accessories which connect the straps.

That is, in the conventional connection of the strap and the strap accessory, one or more slots into which the strap can be inserted are formed, and the strap is wrapped and connected to the strap bar forming these slots.

There are two methods of connecting straps: one being to fix the strap by wrapping the strap around the strap bar and sewing it; and the other being to wrap the strap around the strap bar without fixing the strap to allow adjustment of the length.

The work of individually inserting and connecting the straps into the slots was very cumbersome. Furthermore, in case of the strap on the fixed side, it was necessary to first insert the strap into the strap accessory and wrap the strap around the strap accessory and then sew the strap, and in the state in which the strap accessory was suspended, the strap accessory was mounted on an object, such as a bag or a backpack. So, the work was very inconvenient.

On the other hand, when the strap accessory is used, the strap is pulled or a load is applied to the strap, so the load is concentrated on the strap bar where the strap is connected. So, a portion which is first damaged is the strap bar.

All items using straps become unusable when the strap bar is damaged. In addition, the strap bar is generally formed integrally with the entire accessory such as a buckle, so if the strap bar is damaged, the entire accessory must be replaced.

Therefore, when the strap bar is damaged, there is a significant economic loss, and since consumers generally do not have spare accessories on hand, they must go through a separate procedure for replacement, so there are wastes of time and manpower or the entire product must be discarded.

Specifically, if the strap is fixed to a bag or a backpack by sewing, since the entire strap must be removed, it may even damage the bag or backpack.

RELATED ART

Korean Patent No. 10-1030366 (Apr. 13, 2011)

SUMMARY

Accordingly, the present invention has been made to solve the above-mentioned problems occurring in the prior arts, and it is an objective of the present invention to provide a strap bar device capable of exchanging a strap bar which winds and connects a strap in a strap accessory using the strap.

It is another objective of the present invention to provide a strap bar device in a strap accessory, wherein the strap bar can be easily attached and detached, thereby facilitating convenient use and connection of the strap.

To accomplish the above object, according to the present invention, there is provided a strap bar device including: a strap accessory which includes two support parts facing each other to be spaced apart from each other, and a through-hole and a support groove formed in the two support parts to face each other; and a strap bar which is inserted through the through-hole and is supported in the through-hole and the support groove, wherein a strap is connected to the strap bar.

The support groove and a front end of the strap bar inserted into the support groove, and the through-hole and a rear end of the strap bar coupled to the through-hole may be formed with polygonal cross-sections which match each other.

A head groove expanded more than the through-hole may be formed on the outside of the through-hole, and a head part seated in the head groove may be expanded and formed at the rear end of the strap bar.

A coupling protrusion may be protrudingly formed at the front end of the strap bar so as to be inserted into the support groove.

A plurality of ribs may be formed on the outer surface of the strap bar.

A fixing means for fixing the strap bar on the support part may be formed on the strap bar or the support part.

The fixing means may include a hook piece which is elastically formed on one side adjacent to the outer end of the strap bar, such that when the strap bar is fully coupled to the support part, the hook piece is elastically coupled to the inside of the through-hole.

The strap accessory may be a strap adjuster which is inserted into the strap to adjust the length of the strap or to connect to another strap accessory.

The strap accessory may be a buckle for a backpack or a bag.

The strap accessory may be a loop capable of connecting various items.

According to an embodiment of the present invention, when the strap bar is damaged during the use of the strap accessory, the strap bar alone can be replaced and used without the need to exchange the entire strap accessory, thereby enabling convenient refill usage and reducing economic loss.

According to an embodiment of the present invention, before connection of the strap bar, the end of the strap is wound and sewed in advance, and then, connected to the strap bar, thereby making the sewing and connecting operations convenient.

According to an embodiment of the present invention, the exchangeably connected strap bar can be fixed in the through-hole and the support groove without rotation, thereby maintaining the connection state of the strap stably.

According to an embodiment of the present invention, the strap bar device is simple in operation since the assembly and disassembly of the strap bar can be easily performed, and can be used in safety since the strap bar can be fixed firmly by the fixing means.

The advantages of the present disclosure are not limited to the above-mentioned advantages, and other advantages, which are not specifically mentioned herein, will be clearly understood by those skilled in the art from the following description.

DETAILED DESCRIPTION

Figure 1:
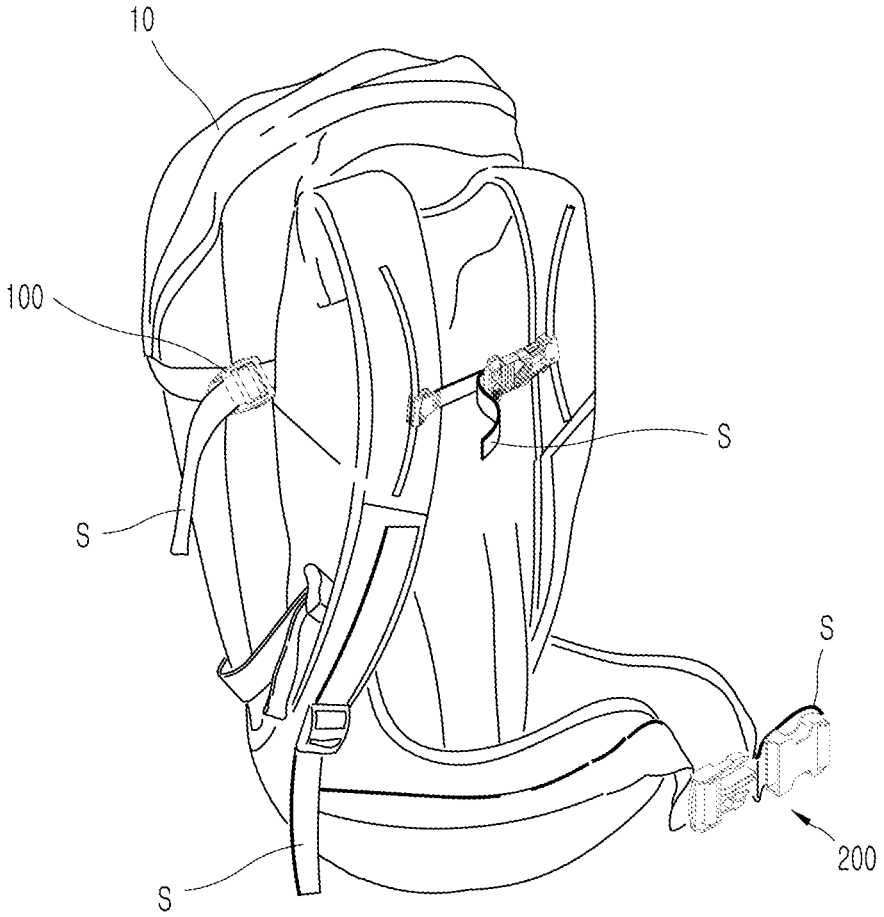
FIG. 1 is a perspective view of a backpack showing an example of mounted strap accessories.

In the drawings, thicknesses of lines and sizes of constituent elements may be exaggerated for clarity and convenience in explanation.

Further, terms to be described later are defined in consideration of the functions of the present invention, and may differ depending on the intentions of a user or an operator or custom. Accordingly, such terms should be defined on the basis of the contents of the overall specification. As described above, belts or straps are attached to a hiking backpack or a bag. In the case of hiking backpack, straps can be applied for various purposes such as shoulder straps, chest straps, and waist straps. So, the straps can be applied in the concept that includes all kinds of straps and cords for connection and detachment, and hereinafter, it will be described uniformly as a strap.

The embodiments described below can be realized in various different forms. In order to more clearly describe the characteristics of the embodiments, a detailed description of matters well known to those of ordinary skill in the art to which the present embodiments belong will be omitted.

Figure 2:
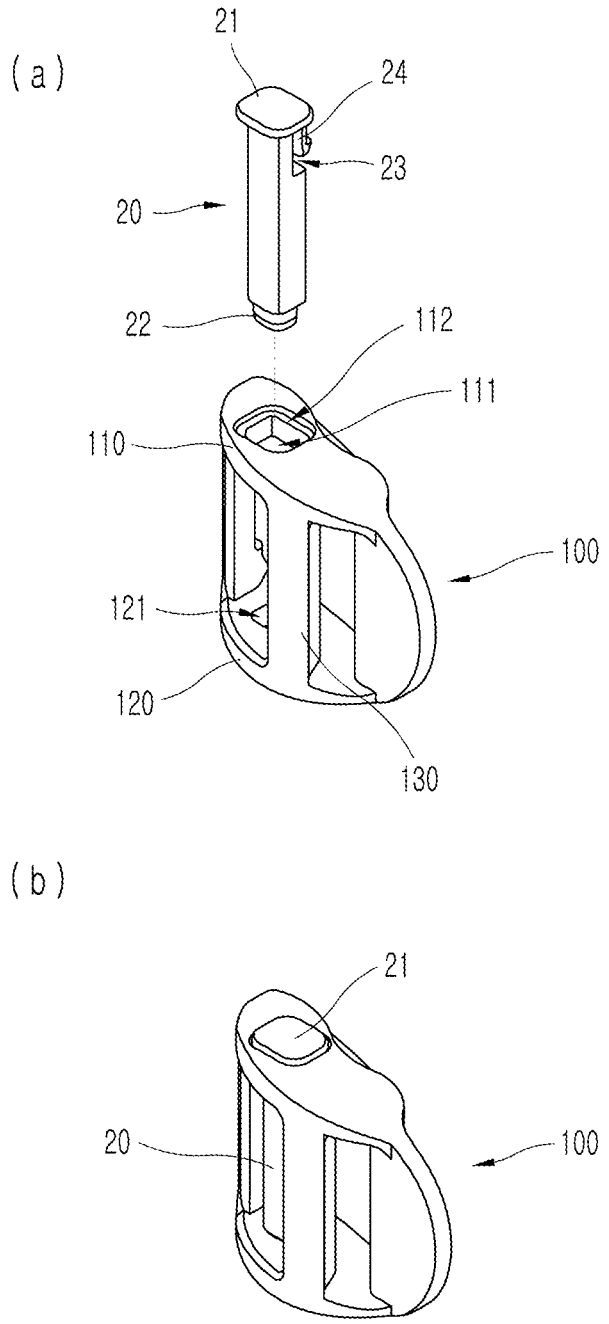
FIG. 2, (a) is a perspective view illustrating a disassembled state and FIG. 2, (b) is a perspective view illustrating an assembled state of the strap adjuster according to an embodiment of the present invention.
Figure 4:
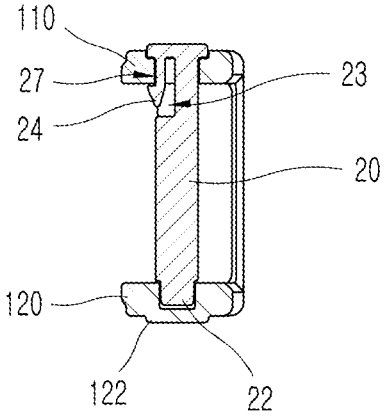
FIG. 4, (a) is a sectional view taken along line A-A of FIG. 3, (b), and FIG. 4, (b) is a sectional view of the disassembled state taken along line A-A of FIG. 3, (b).
Figure 4:
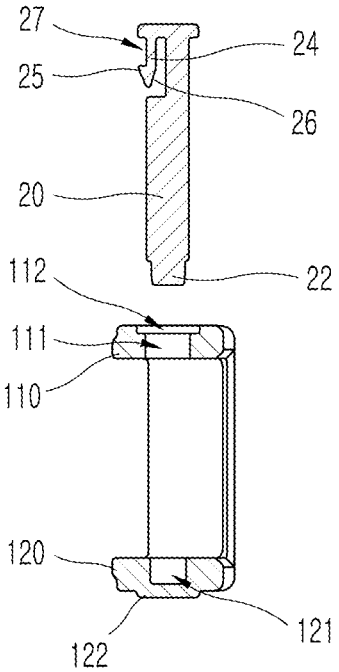
Figure 5:
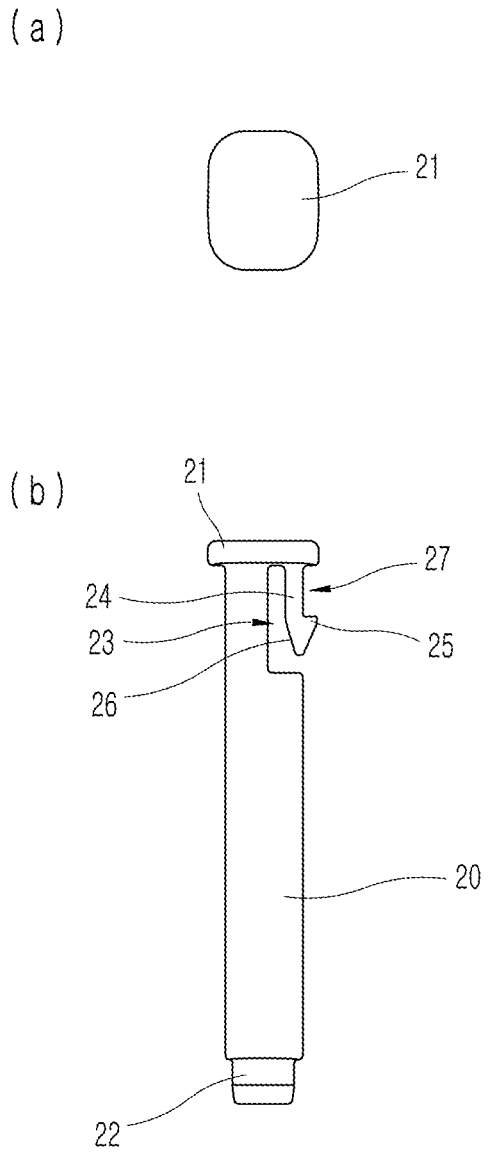
FIG. 5, (a) is a plan view and FIG. 5, (b) is a side view illustrating an example of a strap bar.
Figure 6:
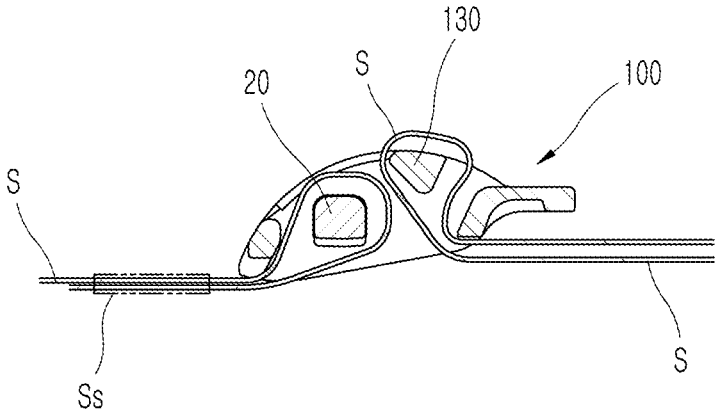
FIG. 6 is a sectional view taken along line B-B of FIG. 3, (b), showing a connected state of a strap.

FIGS. 2 to 6 illustrate a first embodiment in which a strap bar according to the present invention is applied to a strap adjuster as a strap accessory. FIG. 2, (a) is a perspective view illustrating a disassembled state and FIG. 2, (b) is a perspective view illustrating an assembled state of the strap adjuster according to an embodiment of the present invention, FIG. 3, (a) is a perspective view of the disassembled state and FIG. 3, (b) is a front view of the assembled state of the strap adjuster viewed from a different direction, FIG. 4, (a) is a sectional view taken along line A-A of FIG. 3, (b), and FIG. 4, (b) is a sectional view of the disassembled state taken along line A-A of FIG. 3, (b), FIG. 5, (a) is a plan view and FIG. 5, (b) is a side view illustrating an example of a strap bar, and FIG. 6 is a sectional view taken along line B-B of FIG. 3, (b), showing a connected state of a strap.

The strap bar device according to the present invention includes: a strap accessory which includes two support parts facing each other to be spaced apart from each other, and a through-hole and a support groove formed in the two support parts to face each other; and a strap bar which is inserted through the through-hole and is supported in the through-hole and the support groove, wherein a strap is connected to the strap bar by wrapping around the strap bar.

Referring to FIGS. 2 to 6, the strap bar device according to the present invention includes a strap adjuster 100 as the strap accessory, and the strap bar 20 which is detachably assembled to the strap adjuster 100.

The strap adjuster 100 generally has a strap S connected to both sides thereof, wherein one side is fixed by sewing, and the other side is adjustable in length without being fixed. That is, the strap connected to both sides are divided into a fixed end and a free end.

At least one of the strap bar connected to the strap of the free end and the strap bar connected to the strap of the fixed end may be formed as a detachable type.

Since the strap of the free end is not fixed by sewing for length adjustment, it is easily detachable from the strap adjuster. Therefore, the strap bar connected to the strap of the free end is not inconvenient in assembling work even if it is not detachably mounted. However, since the strap of the fixed end is mounted by wrapping around the fixed end and being sewed, if a user wants to replace the strap after being mounted, the entire strap must be removed. Therefore, it is more preferable to make the strap bar of the fixed end as a detachable type.

The strap adjuster 100 has opposing support parts 110 and 120 formed on both sides thereof through which the strap passes, and the strap bar 20 according to the present invention and a cross bar 130 are mounted between the support parts 110 and 120 to connect the strap.

The strap bar 20 is formed in a pin shape and is mounted on both support parts 110 and 120 of the strap adjuster 100.

For this purpose, a through-hole 111 through which the strap bar 20 passes is formed in one of the support parts 110, and a support groove 121 is formed in the other support part 120 to face the through-hole 111, so that the front end of the strap bar 20 is inserted and supported.

Therefore, assembly is completed by inserting the strap bar 20 into the through-hole 111 and placing the front end in the support groove 121.

That is, the front end of the strap bar 20 is supported in the support groove 121, and the rear end of the strap bar 20 is coupled to be supported in the through-hole 111.

Here, the cross-sectional shapes of the through-hole 111 and the support groove 121 are made in a polygonal shape, and coupling portions of the strap bar 20 corresponding thereto are also formed in the polygonal shape to match the through-hole 111 and the support groove 121, so that the strap bar 20 can be stably fixed without rotation in the coupled state.

A head groove 112 expanded more than the through-hole 111 can be formed on the outside of the through-hole 111, and a head part 21 seated in the head groove 112 can be expanded and formed at the rear end of the strap bar 20.

Moreover, a coupling protrusion 22 is protrudingly formed at the front end of the strap bar 20, so as to be inserted into and coupled to the support groove 121. It is preferable that the coupling protrusion 22 is formed to be stepped from a body of the strap bar 20 and to be smaller than the body of the strap bar 20.

The sizes and shapes of the head groove 112, the head part 21, the support groove 121, the coupling protrusion 22, and the like can be formed in various ways, and can be arbitrarily applied depending on the strap accessories applied.

Figure 3:
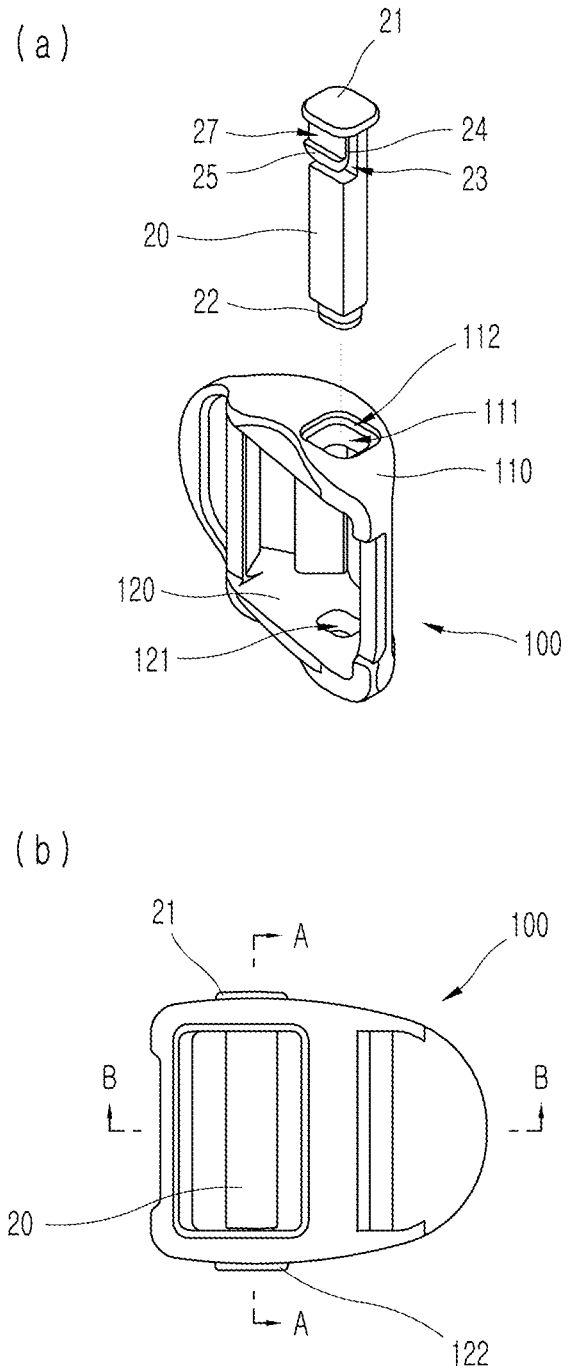
FIG. 3, (a) is a perspective view of the disassembled state and FIG. 3, (b) is a front view of the assembled state of the strap adjuster viewed from a different direction.

For example, as illustrated in FIG. 3, (b) and FIG. 4, a protrusion 122 may be further formed outward from the support part 120 to sufficiently secure a space of the support groove 121 when the support groove 121 is formed. Accordingly, the head part 21 of the strap bar 20 may protrude outward from the opposing support part 110 such that the protruding shape of the head part 21 is the same as the protrusion 122. Therefore, the protruding shapes of both support parts 110 and 120 can be symmetrically formed, thereby providing the aesthetic appearance.

The strap bar 20 may be provided with fixing means for maintaining a coupled state between the strap accessory and the strap bar 20.

Therefore, the strap bar 20 can be fixed to the strap accessory by the fixing means or separated from the strap accessory by releasing the fixing means.

The fixing means includes: a recess 23 formed on one side near the outer end, i.e., the head part 21 of the strap bar 20; a hook piece 24 elastically extended in the longitudinal direction inside the strap bar 20 within the recess 23; a locking part 25 protruding above the one side from the free end of the hook piece 24; and a coupling groove 27 formed between the head part 21 and the locking part 25.

Therefore, when the strap bar 20 is completely coupled to the strap adjuster 100, the support part 110 is coupled to the coupling groove 27 as the hook piece 24 is elastically retained to the inside of the through-hole 111 such that the strap bar 20 is coupled and fixed.

As illustrated in the plan view of FIG. 5, (a), the cross-section of the strap bar 20 may be formed longer on one side like a rectangle. Specifically, the direction of the longer side coincides with the lateral direction of the hook piece 24.

This is to form the recess 23 to form the hook piece 24 as a fixing means, thereby compensating for the point that the thickness of the corresponding part may become thin and the strength may be weakened. So, it is preferable that the fixing means is formed long in the direction in which the strap is pulled.

FIG. 6 illustrates a state in which the strap S is connected in both directions of the strap adjuster 100, wherein one side of the strap forms the fixed end by wrapping around the strap bar 20 and being fixed with a sewing line Ss, and the other side of the strap wraps around the cross bar 130 so that two lines are extended as they are to allow adjustment of the length of the strap.

Therefore, in a case in which the strap bar 20 is damaged during the use of the strap adjuster, only the strap bar 20 can be separated and easily replaced with a new strap bar. In addition, if other parts, such as the cross bar 130, are damaged, since the strap adjuster 100 must be separated from the strap of the fixed end, so the strap bar 20 can be easily detached, thereby facilitating the exchange of the strap adjuster 100.

Figure 7:
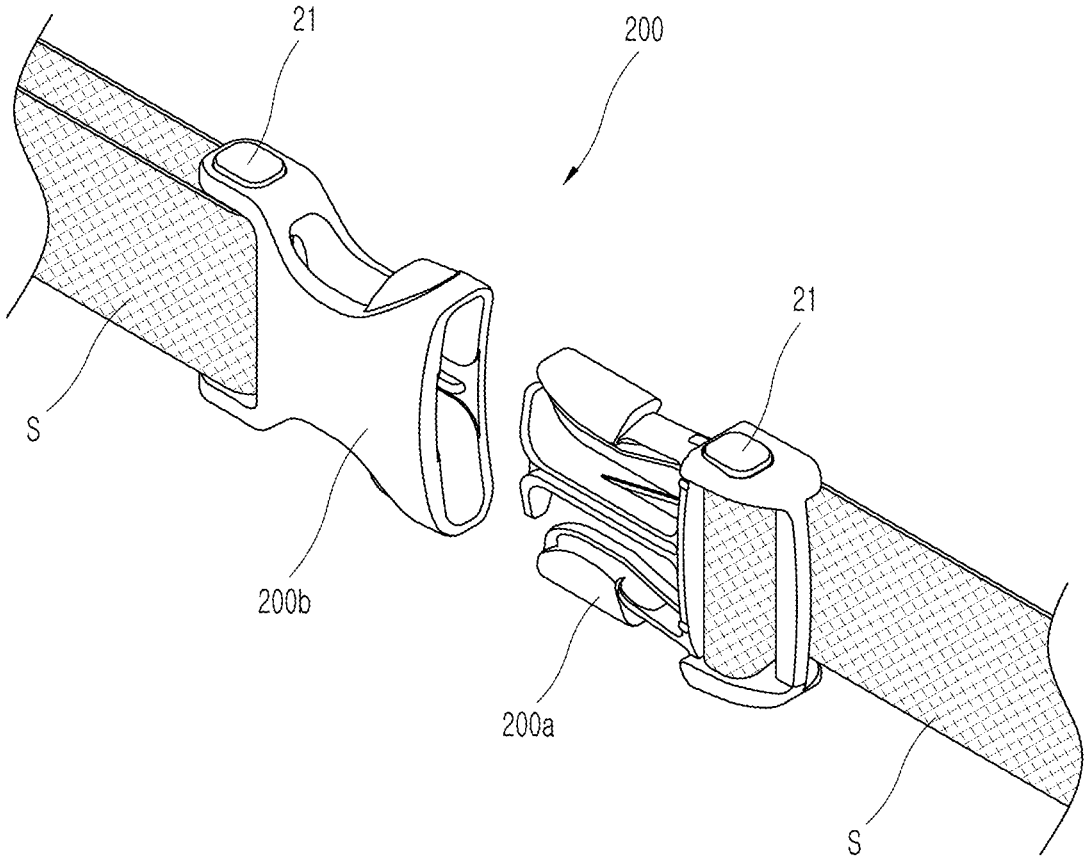
FIG. 7 is a perspective view showing a buckle as a strap accessory.
Figure 8:
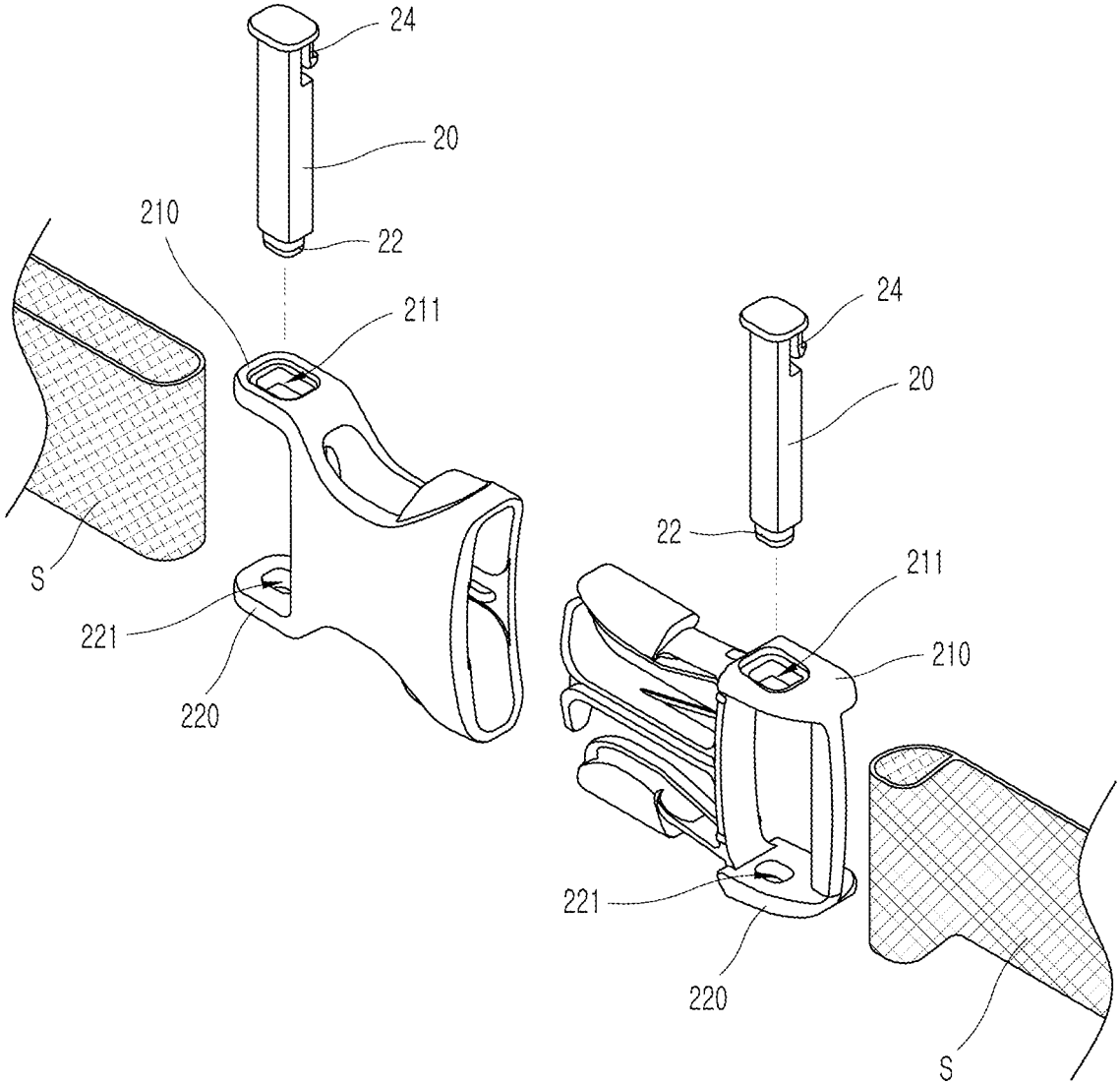
FIG. 8 is an exploded perspective view of FIG. 7.
Figure 9:
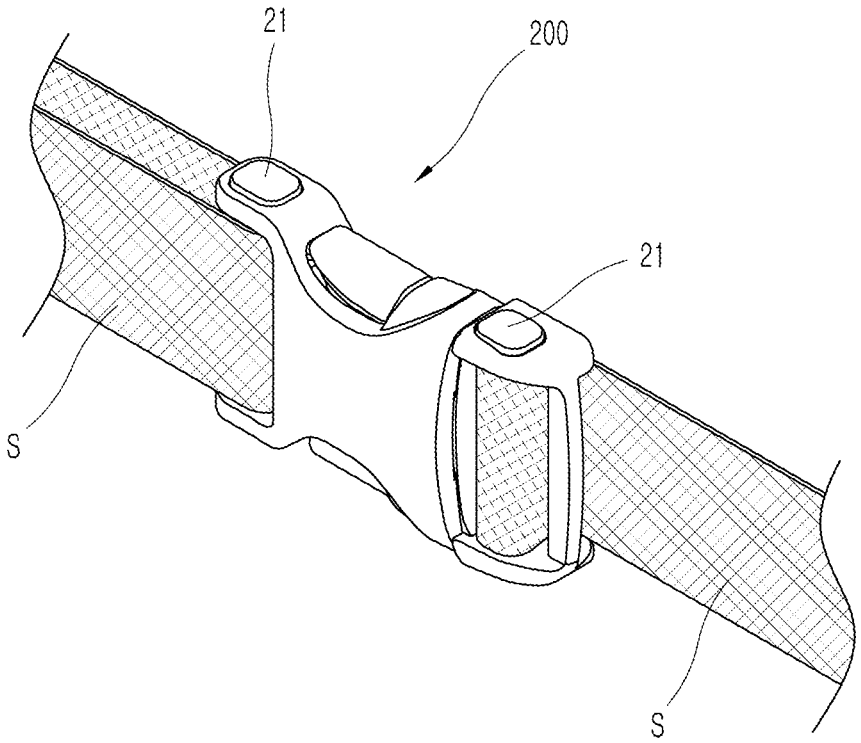
FIG. 9 is an assembled perspective view of FIG. 7.

FIGS. 7 to 12 illustrate a second embodiment of the strap bar according to the present invention applied to a buckle which is widely used in a backpack, wherein FIG. 7 is a perspective view of the buckle as a strap accessory, FIG. 8 is an exploded perspective view of FIG. 7, and FIG. 9 is a perspective view illustrating an assembled state of FIG. 7.

Referring to FIGS. 7 to 9, the buckle 200 as a strap accessory includes a plug member **200*a* and a socket member 200*b*, which are detachably connected to each other, and the strap is connected backwards, wherein one side of the strap is sewed and connected in a fixed state. In the drawings, it is illustrated that the strap connected to the plug member 200*a*** is in a fixed state.

Facing support parts 210 and 220 are formed at the rear ends of the plug member **200*a* and the socket member 200*b*, and the strap bar 20 according to the present invention is mounted between the support parts 210 and 220** to connect the strap.

A through-hole 211 through which the strap bar 20 passes is formed in one of the support parts 210, and a support grove 221 is formed in the other support part 220 to face the through-hole 211, so that the front end of the strap bar 20 is inserted and supported.

Therefore, assembly is completed when the strap bar 20 is inserted through the through-hole 211 and the front end is seated in the support groove 221.

A hook piece 24 as a fixing means is mounted at the rear end of the strap bar 20, and is elastically coupled with the through-hole 211.

The configuration of the strap bar 20, the through-hole 211 and the support groove 221 in which the strap bar 20 is inserted may be made in the same manner as the configuration of the first embodiment, so a repetitive description will be omitted.

Figure 10:
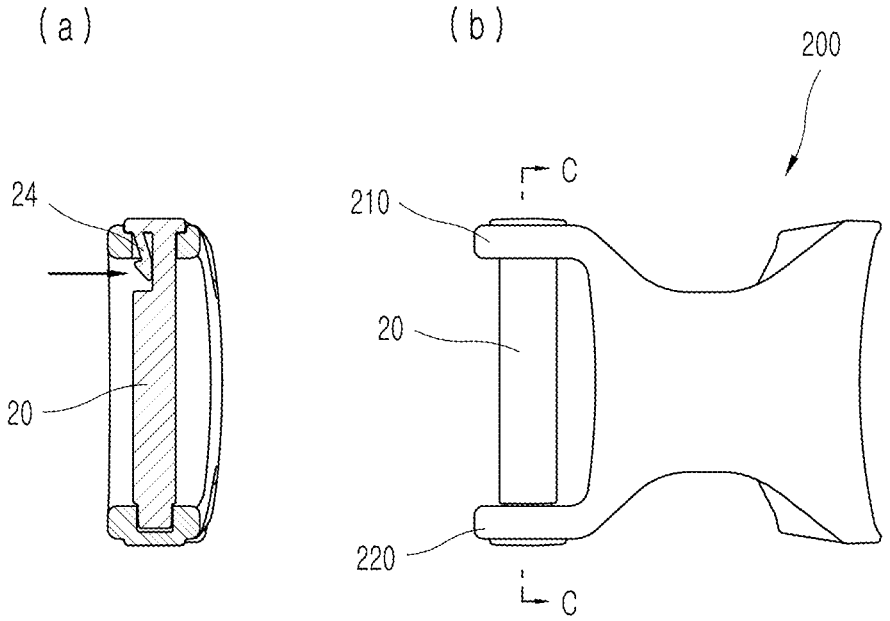
FIGS. 10 to 12 are sectional views and front views illustrating a state in which the strap bar is removed from a buckle.
Figure 11:
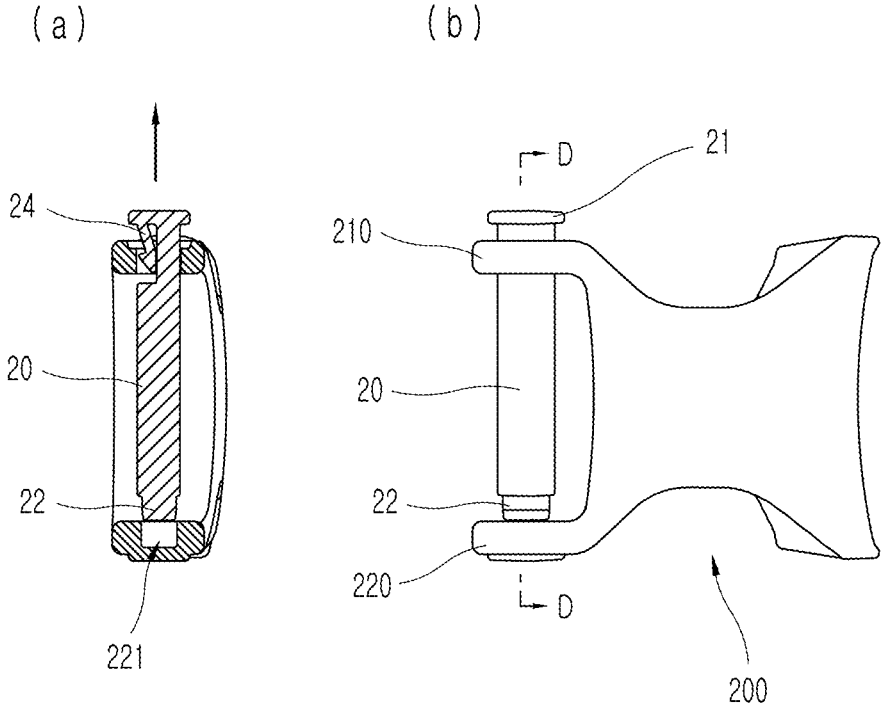
Figure 12:
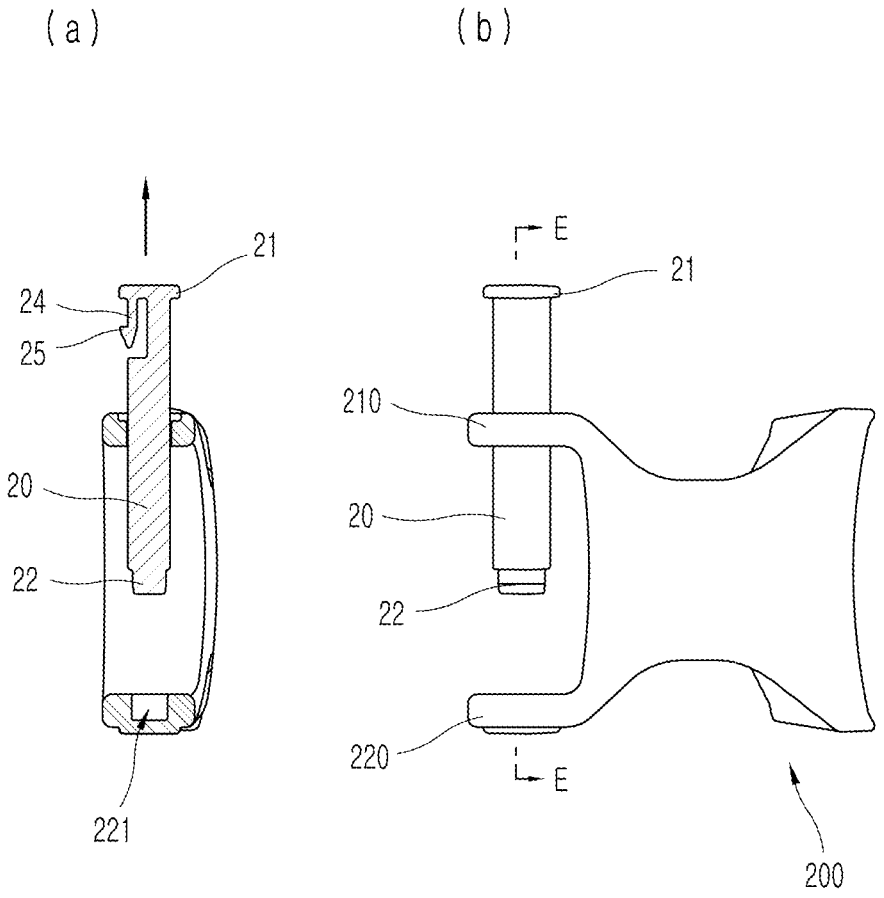

FIG. 10 to 12 are sectional views and front views illustrating a state in which the strap bar is removed from a buckle, wherein FIG. 10, (a), FIG. 11, (a) and FIG. 12, (a) are sectional views taken along lines C-C, D-D, and E-E of FIG. 10, (b), FIG. 11, (b) and FIG. 12, (b), respectively.

Referring to FIGS. 10 to 12, a strap removal state will be described. In the state in which the strap bar 20 is coupled to the buckle 200, as illustrated in FIG. 10, (a), when a user presses the locking part 25 of the hook piece 24 in an arrow direction, the strap bar is removed out. FIG. 11 illustrates a state in which the hook piece 24 moves inside the through-hole 211, and FIG. 12 illustrates a state in which the hook piece 24 gets completely out of the through-hole 211.

That is, the strap bar 20 can be simply separated just by pressing and pushing the hook piece 24.

For an efficient space utilization when the locking part 25 of the front end of the hook piece 24 is pressed, as illustrated in FIG. 5, an inclined surface 26 may be formed on the inner side of the front end of the hook piece 24. By forming the inclined surface 26, a deeper rotation angle of the hook piece 24 can be secured.

Figure 13:
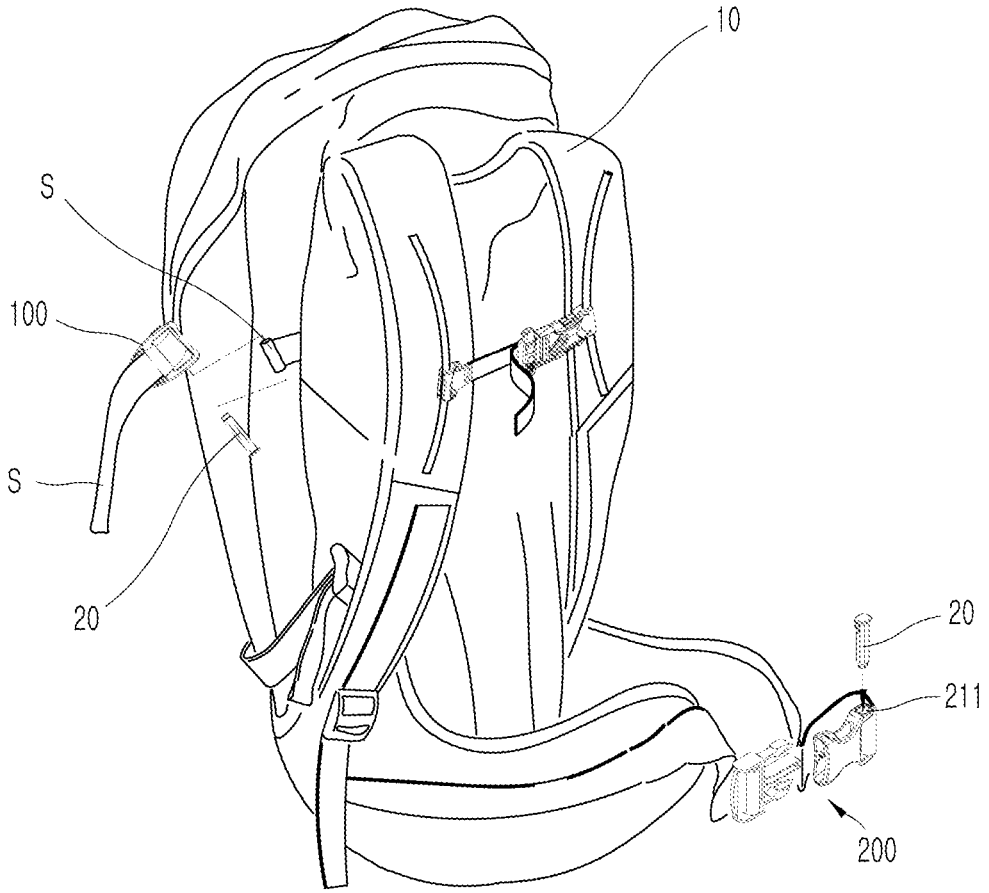
FIG. 13 is a perspective view illustrating a backpack as an example, to which strap accessories according to the present invention are mounted.

FIG. 13 is a perspective view illustrating a backpack as an example, to which strap accessories according to the present invention are mounted. Referring to FIG. 13, the strap adjuster 100 described in the first embodiment of the present invention is mounted at the top of the left, and the buckle 200 described in the second embodiment is mounted and used at the bottom of the right.

Figure 14:
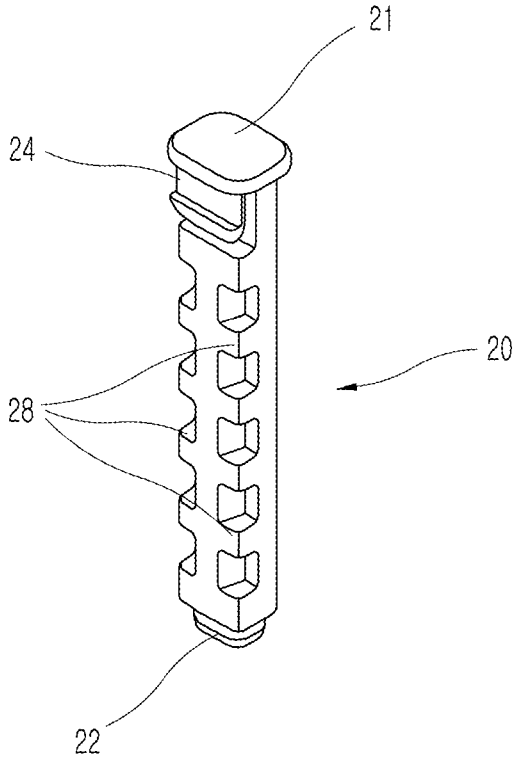
FIG. 14 is a perspective view illustrating a strap bar according to another embodiment of the present invention.

FIG. 14 is a perspective view illustrating a strap bar according to another embodiment of the present invention. In FIG. 14, continuous and repetitive ribs 28 are formed on the body of the strap bar 20 to increase rigidity while saving materials.

Figure 15:
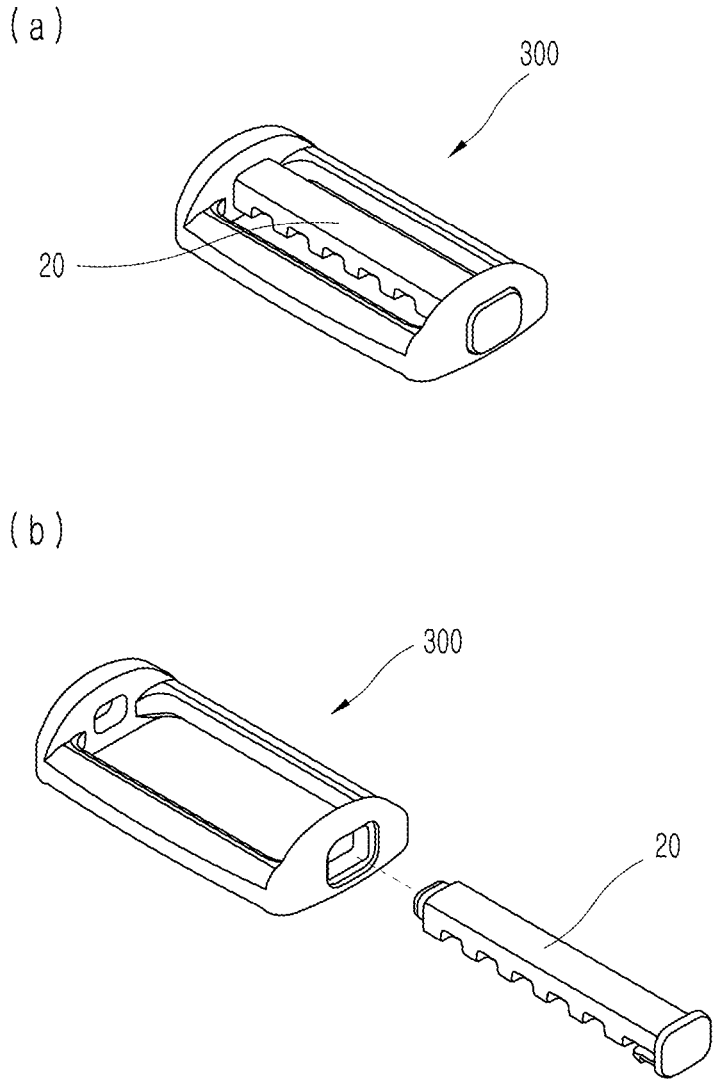
FIGS. 15 to 17 are perspective views illustrating other examples of applications of the strap accessories.
Figure 16:
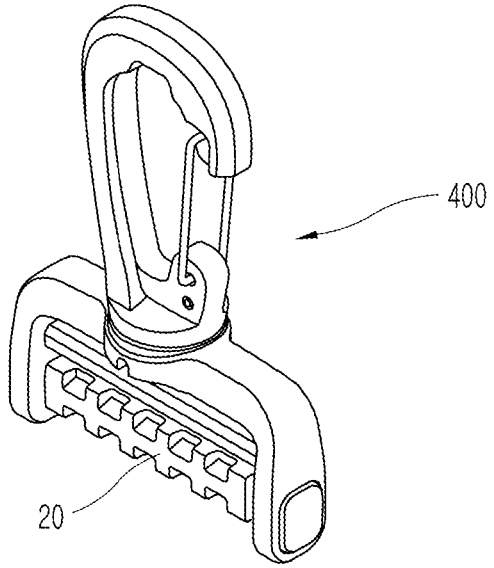
Figure 16:
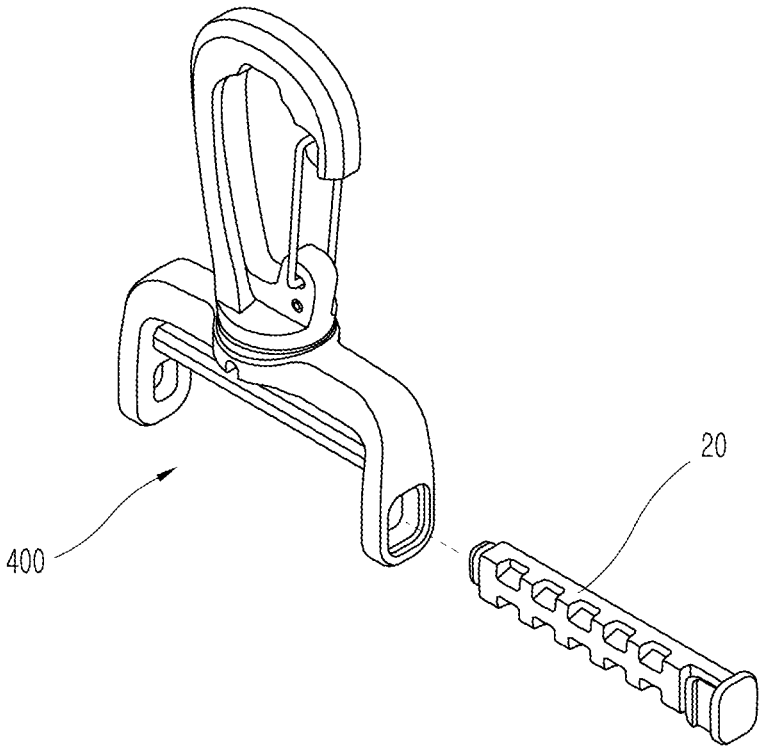
Figure 17:
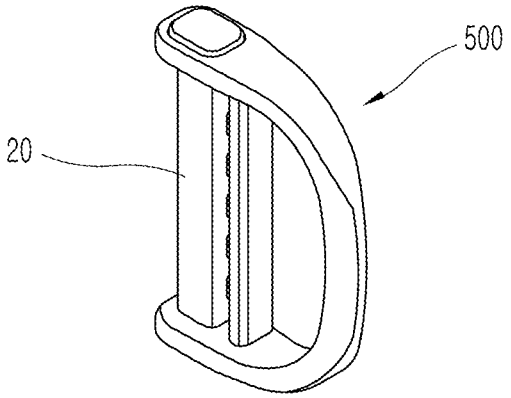
Figure 17:
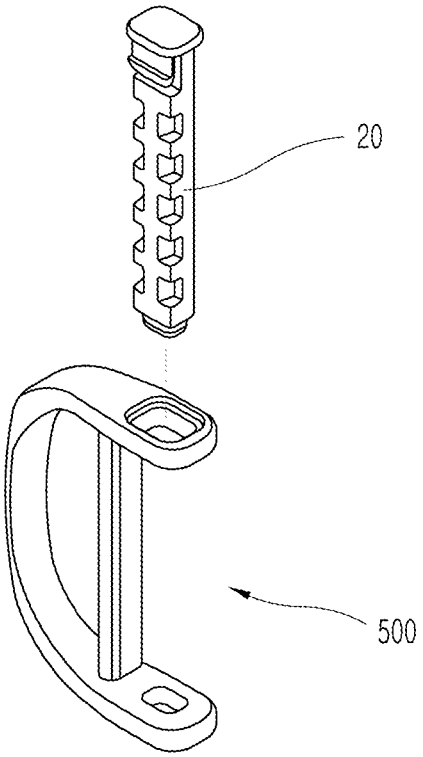

FIGS. 15 to 17 are perspective views illustrating other examples of applications of the strap accessories, wherein FIG. 15, (a) is a perspective view of a different type of strap adjuster 300, and FIG. 15, (b) is a perspective view of the strap bar 20 in a disassembled state.

FIG. 16, (a) is a perspective view illustrating a state in which the strap bar 20 of the present invention is mounted on a loop 400, and FIG. 16, (b) is a perspective view of the strap bar 20 in a disassembled state.

FIG. 17, (a) is a perspective view illustrating a state in which the strap bar 20 of the present invention is mounted on a D-ring 500, and FIG. 17, (b) is a perspective view of the strap bar 20 in a disassembled state.

In addition, the strap bar of the present invention can be applied to various strap accessories to which straps are connected.

The above description is only exemplary, and it will be understood by those skilled in the art that the invention may be embodied in other concrete forms without changing the technological scope and essential features. Therefore, these embodiments as described above are only proposed for illustrative purposes and do not limit the present invention.

It will be apparent to those skilled in the art that a variety of modifications and variations may be made without departing the spirit and scope of the present invention as defined by the appended claims. Further, such modifications and variations should not be understood independently from the technical idea or perspective of the present invention.

What is claimed is:

1. A strap bar device comprising:

a strap accessory including:

a first support part having a through-hole extending therethrough, and a second support part spaced apart from the first support part, the second support part including:

a first surface facing the first support part and including a support groove aligned with the through-hole, and a second surface opposite to the first surface, wherein the support groove has a closed bottom that does not penetrate the second surface; and a strap bar inserted through the through-hole and supported by the through-hole and the support groove, without penetrating the second support part, wherein the strap bar includes:

a head part larger than the through-hole, a recess formed on an outer surface of the strap bar adjacent to the head part, and a hook piece elastically extending from the head part over the recess and positioned within the recess along a longitudinal direction of the strap bar, wherein the hook piece passes through the through-hole of the first support part and engages a portion of the first support part, which faces the first surface of the second support part when the strap bar is fully coupled to the first support part, wherein a strap is connected to the strap bar.

2. The strap bar device according to claim 1, wherein the support groove and a front end of the strap bar inserted into the support groove, and the through-hole and a rear end of the strap bar coupled to the through-hole are formed with polygonal cross-sections which match each other.

3. The strap bar device according to claim 1, wherein a head groove expanded more than the through-hole is formed on an outside of the through-hole, and the head part seated in the head groove is expanded and formed at a rear end of the strap bar.

4. The strap bar device according to claim 1, wherein a coupling protrusion is protrudingly formed at a front end of the strap bar so as to be inserted into the support groove.

5. The strap bar device according to claim 1, wherein a plurality of ribs are formed on an outer surface of the strap bar.

6. The strap bar device according to claim 1, wherein the strap accessory is a strap adjuster which is inserted into the strap to adjust the length of the strap or to connect to another strap accessory.

7. The strap bar device according to claim 1, wherein the strap accessory is a buckle for a backpack or a bag.

8. The strap bar device according to claim 1, wherein the strap accessory is a loop capable of connecting various items.

* * * * *